US009333410B1

(12) United States Patent
Myers

(10) Patent No.: US 9,333,410 B1
(45) Date of Patent: May 10, 2016

(54) PUTTER ALIGNMENT AID

(71) Applicant: CALLAWAY GOLF COMPANY, Carlsbad, CA (US)

(72) Inventor: Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 14/919,524

(22) Filed: Oct. 21, 2015

Related U.S. Application Data

(60) Provisional application No. 62/208,498, filed on Aug. 21, 2015.

(51) Int. Cl.
*A63B 69/36* (2006.01)

(52) U.S. Cl.
CPC ..... *A63B 69/3685* (2013.01); *A63B 2069/3682* (2013.01)

(58) Field of Classification Search
CPC ..... A63B 69/3685; A63B 2069/3682
USPC ..... 473/231, 238, 240, 241, 249–254
See application file for complete search history.

(56) References Cited

U.S. PATENT DOCUMENTS

| | | | | | |
|---|---|---|---|---|---|
| 4,032,156 | A * | 6/1977 | Clarke | A63B 69/3685 | 473/253 |
| 4,458,900 | A * | 7/1984 | Antonious | A63B 53/0487 | 473/254 |
| 5,725,441 | A * | 3/1998 | Jensen | A63B 69/3685 | 473/251 |
| 7,226,362 | B1 * | 6/2007 | Schell | A63B 53/0487 | 473/238 |
| 8,425,341 | B2 * | 4/2013 | Takechi | A63B 53/0466 | 473/242 |
| 2003/0064820 | A1 * | 4/2003 | Middleton | A63B 53/0487 | 473/226 |
| 2009/0186718 | A1 * | 7/2009 | Ross | A63B 53/0487 | 473/340 |

* cited by examiner

*Primary Examiner* — Nini Legesse
(74) *Attorney, Agent, or Firm* — Rebecca Hanovice; Michael Catania; Sonia Lari

(57) ABSTRACT

A golf club head comprising a three dimensional alignment feature is disclosed herein. In particular, the golf club head, which preferably is a putter, comprises a conical bore having a plurality of concentric rings. The concentric bore extends into a top surface of the head, and when a golfer has properly aligned his or her head relative to a golf ball and the club head, each of the plurality of concentric rings is fully visible to the golfer, with no part of any ring obscured by any other part of the golf club head.

17 Claims, 4 Drawing Sheets

PUTTER ALIGNMENT AID

CROSS REFERENCES TO RELATED APPLICATIONS

The present application claims priority to U.S. Provisional Patent Application No. 62/208,498, filed on Aug. 21, 2015, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head, particularly a putter, with a conical bore extending into an upper surface and having a plurality of alignment rings that appear to be concentric when viewed from the proper angle.

2. Description of the Related Art

The prior art discloses many different types of alignment aids disposed on golf club heads, and on putters in particular. In fact, nearly all putters in the marketplace include some type of two dimensional alignment aid, usually in the form of a paint-filled feature on the topline of the putter head. These alignment aids are intended to give golfers a visual reference for the putter's face center along a horizontal axis, because ball speed and sidespin noticeably change if a golfer hits a ball with the heel or toe side of the putter face instead of with the face center. If a golfer is able to hit a golf ball with the center face of a putter, the distance and roll of the golf ball will be more reliable and predictable. The vast majority of prior art alignment aids are two dimensional, however, and do not optimize alignment during putting. Therefore, there is a need for an improved, three-dimensional putter alignment system that allows a golfer to align his or her head, and the putter itself, with a golf ball when taking a shot.

BRIEF SUMMARY OF THE INVENTION

One aspect of the present invention is a putter comprising a three-dimensional alignment aid extending into an upper surface of the putter head.

Another aspect of the present invention is a golf club head comprising a body comprising a striking face, a top surface, a bottom surface, a heel side, a hosel, and a toe side, and a conical bore extending into the body from the top surface, wherein the conical bore comprises a plurality of alignment rings, wherein the conical bore comprises an upper end having a first diameter and a lower end having a second diameter, wherein the first diameter is greater than the second diameter, and wherein the conical bore is centered between the heel side and the toe side. When viewed from a location directly above the body, the alignment rings preferably appear to be concentric. The plurality of alignment rings may comprise a first ring having a third diameter, a second ring having a fourth diameter, and a third ring having a fifth diameter, the third diameter may be greater than the fourth diameter, and the fourth diameter may be greater than the fifth diameter. In a further embodiment, the first ring may be disposed within the conical bore proximate the top surface, the third ring may be disposed within the conical bore proximate the bottom surface, and the second ring may be disposed within the conical bore between the first and third rings.

In some embodiments, the conical bore may comprise a surface comprising a first color, and at least one of the plurality of alignment rings may comprise a second color that is different from, and contrasts with, the first color. The first color may be a light color, such as white, and the second color may be a dark color, such as black. In some embodiments, the conical bore may be disposed proximate the striking surface, and the conical bore may extend through the bottom surface. In another embodiment, at least one of the plurality of alignment rings may protrude into the conical bore, and in a further embodiment, each of the plurality of alignment rings may protrude into the conical bore. In some embodiments, the golf club head may be a putter head. In others, the first diameter may be approximately the same diameter as that of a golf ball. In alternative embodiments, the first diameter may be less than 0.500 inch. In other embodiments, the bottom surface may be composed of a transparent material so that the ground is visible to a golfer when his or her head is properly aligned with the club head.

Yet another aspect of the present invention is a putter head comprising a body comprising a top surface, a bottom surface, a heel side, a toe side, a front surface comprising a recess, a hosel, and a rear portion, a face insert sized to fit within the recess, and a conical bore extending into the top surface, wherein the conical bore comprises a plurality of alignment rings, wherein at least one of the plurality of alignment rings protrudes into the conical bore, wherein the conical bore comprises an upper end having a first diameter and a lower end having a second diameter, wherein the first diameter is greater than the second diameter, wherein the conical bore is located closer to the front surface than to the rear portion, and wherein the conical bore is centered between the heel and toe sides. In some embodiments, the first diameter may be approximately the same diameter as that of a golf ball. In others, the conical bore may extend through the bottom surface. In yet another embodiment, the conical bore may comprise a surface comprising a first color, and at least one of the plurality of alignment rings may comprise a second color that is different from the first color. In some embodiments, the conical bore may be spaced from the front surface by no more than 0.500 inch. In still other embodiments, the bottom surface may be composed of a transparent material, and the bottom surface may be visible through the conical bore.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf club head, and particularly a putter, having a three-dimensional alignment aid extending into an upper surface of the head. The alignment aids of the present invention allow a golfer to confirm that his or her head is aligned with respect to the club head and a golf ball before making a putt.

Figure 1:
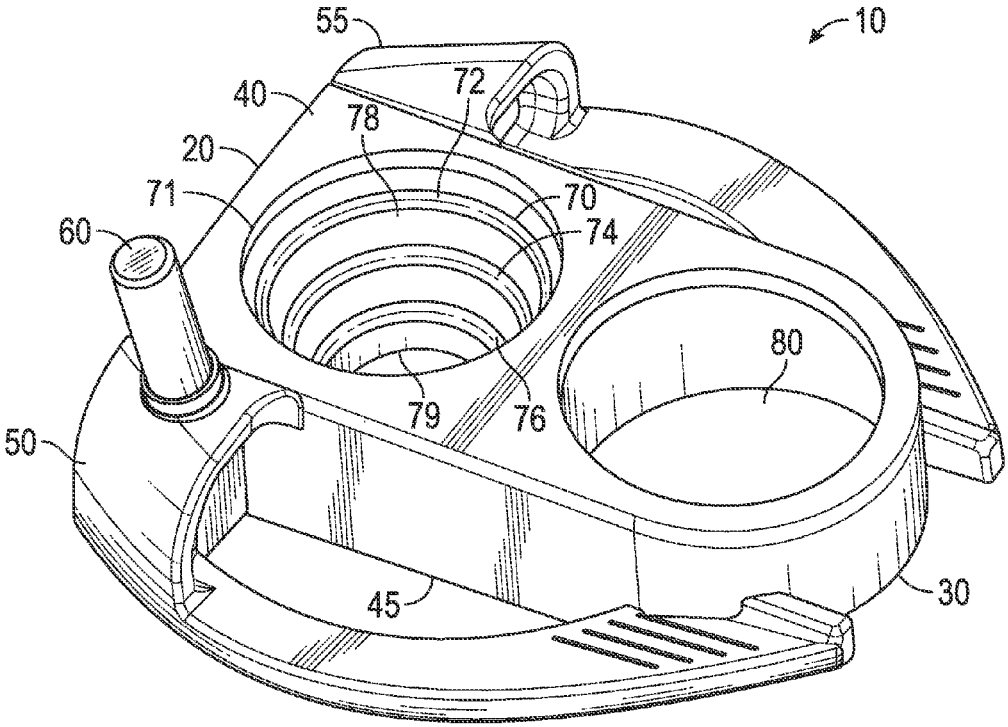
FIG. 1 is a top perspective view of a first embodiment of the present invention.
Figure 2:
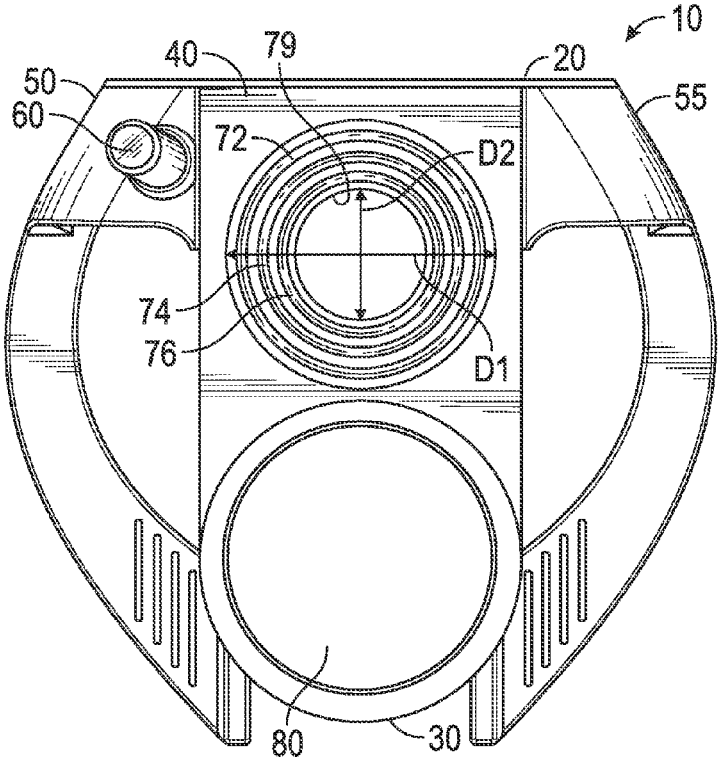
FIG. 2 is a top plan view of the embodiment shown in FIG. 1.

In a first, preferred embodiment, shown in FIGS. 1-2, the putter head 10 has a striking face 20, a rear portion 30 opposite the striking face 20, a top surface 40, a bottom surface 45, a heel side 50, a toe side 55, a hosel 60, and a conical bore 70 extending into the top surface 40. The conical bore 70 is centrally located on the putter head 10 between the heel side 50 and the toe side 55. The conical bore 70 preferably is a through bore, in that it extends through the top surface 40 and the bottom surface 45 so that the ground is visible to a golfer when using the putter head 10, but in alternative embodiments the conical bore 70 may extend only part of the way through the head 10. In such alternative embodiments, the bottom surface 45 may be composed of a transparent or translucent material so that the ground is visible through the conical bore 70, but debris cannot enter the conical bore 70 from below.

As shown in FIGS. 1 and 2, the conical bore 70 has a first diameter $D_1$ at its uppermost edge 71 at the top surface 40 and a second, smaller diameter $D_2$ at its lower most edge 79 at the bottom surface 45, and the diameter of the conical bore 70 gradually decreases from $D_1$ to $D_2$. $D_1$ preferably is approximately equivalent to the diameter of a standard, USGA conforming golf ball, i.e., 1.68 inches, to help with alignment, but in alternative embodiments may be larger or smaller than that. The conical bore 70 also includes three alignment rings 72, 74, 76, which, when viewed from a point directly above the head 10, appear to be concentric as shown in FIG. 2. The conical bore 70 preferably has a visible surface 78 that has a first, light color, while each of the alignment rings 72, 74, 76 is painted a contrasting, darker color. Each of the alignment rings 72, 74, 76 protrudes from the surface 78 of the conical bore 70 so that the conical bore 70 has a ribbed, three-dimensional appearance, especially when viewed from the side as shown in FIG. 1. The alignment rings 72, 74, 76 also decrease in diameter, with the uppermost ring 72 having a greater diameter than the other two rings 74, 76, and the lowermost ring 76 having a smaller diameter than the other two rings 72, 74.

The putter head 10 also includes a secondary conical through bore 80 behind the first conical bore 70 to provide additional alignment assistance. In an alternative embodiment, the putter head 10 has two of these through bores 80, one behind the other, and the conical bore 70 and all of its features is an insert piece that can be moved from one bore 80 to another, depending on where on the putter head 10 the golfer wishes to place the inventive alignment features.

Figure 3:
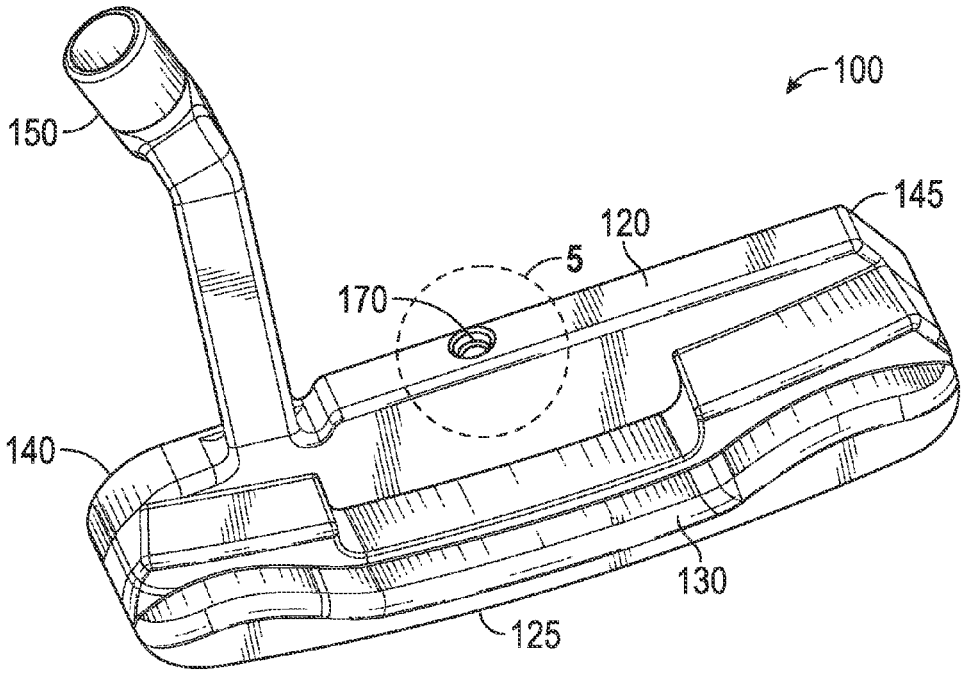
FIG. 3 is a top perspective view of a second embodiment of the present invention.
Figure 4:
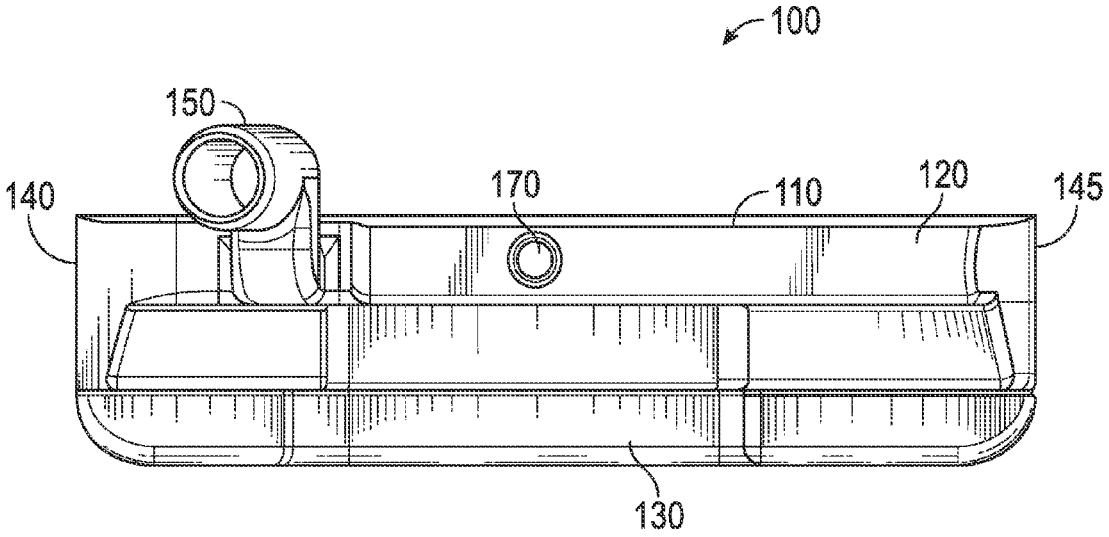
FIG. 4 is a top plan view of the embodiment shown in FIG. 3.
Figure 5:
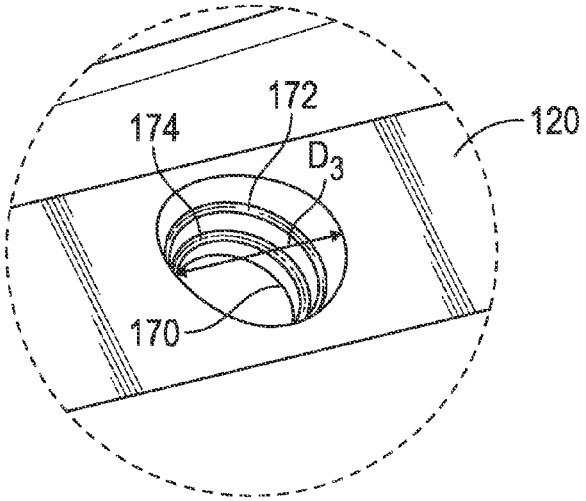
FIG. 5 is a magnified view of the circled portion of the embodiment shown in FIG. 3.

A second embodiment is shown in FIGS. 3-5. In this embodiment, the putter head 100 is a blade-type putter having a striking face 110, a narrow top line 120, a bottom surface 125, a rear portion 130, a heel side 140, a toe side 145, a hosel 150, and a conical through-bore 170 extending vertically through the top line 120 and through the bottom surface 125. In this embodiment, the conical through-bore 170 has a much smaller uppermost diameter than in the preferred embodiment, with an uppermost diameter $D_3$ of less than 1 inch. Due to its reduced size, the conical through-bore 170 has only two alignment rings 172, 174 which, when viewed from a location directly above the conical through-bore 170, appear to be concentric.

Figure 6:
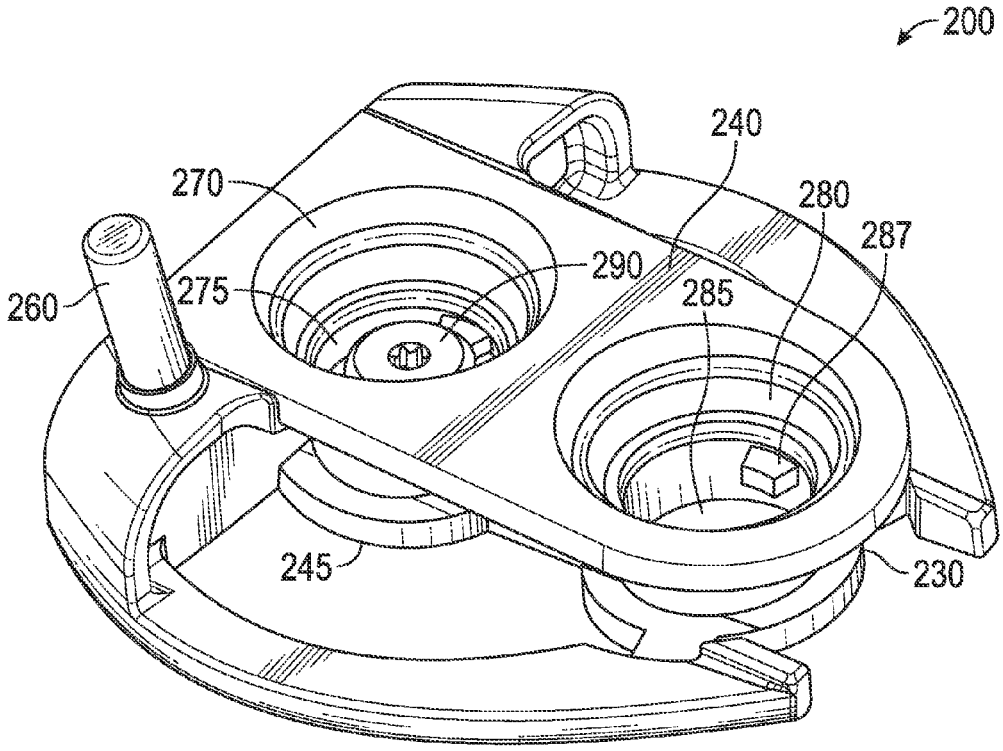
FIG. 6 is a top perspective view of a third embodiment of the present invention.
Figure 7:
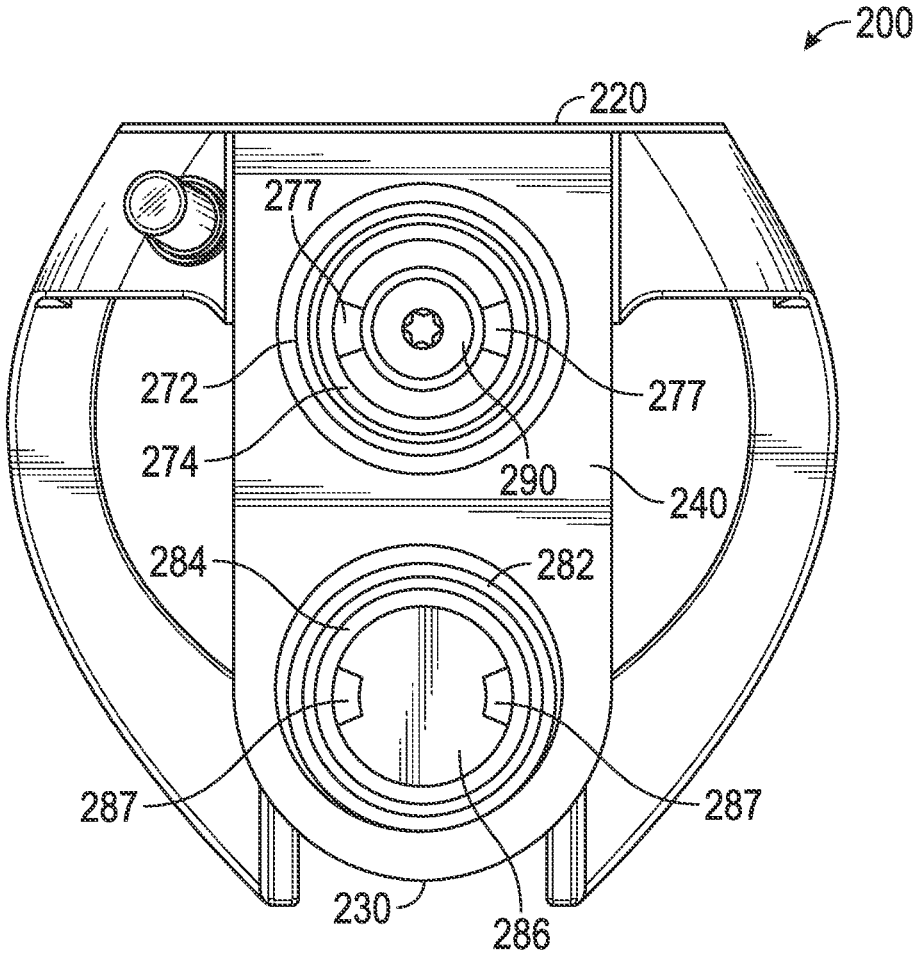
FIG. 7 is a top plan view of the embodiment shown in FIG. 6.

A third embodiment is shown in FIGS. 6-7. This putter head 200 has all of the same features as the first embodiment, including a striking face 220, rear portion 230, top surface 240, bottom surface 245, and hosel 260, except that the bottom surface 245 is shaped to match the general shape of the first and second conical bores 270, 280 and provide a base surface for these conical bores 270, 280, such that they are not complete through-bores. The conical bores 270, 280 bottom out on the bottom surface 245 such that each of these conical bores 270, 280 becomes a weight port, and the lower region 275, 285 of each conical bore 270, 280 includes retention features for a movable weight 290, which in this embodiment comprises cam lock seating tabs 277, 287 but in other embodiments may comprise threads, snaps, pins, or any other mechanical retention feature known to a person skilled in the art. The embodiment shown in FIGS. 6 and 7 includes a cam weight 90, the features of which are disclosed in U.S. patent application Ser. No. 14/823,834, the disclosure of which is incorporated by reference in its entirety herein. The cam weight 90 may include a polymeric o-ring to help secure the cam weight 90 within the conical bores 270, 280.

The embodiment shown in FIGS. 6 and 7 also differs from the first embodiment in that each of the conical bores 270, 280 has two, instead of three, alignment rings 272, 274, 282, 284, which should be fully visible and appear concentric to a golfer when the putter head 200 is properly aligned with a golf ball at address. The conical bores 270, 280 also include base portions 276, 286 against which the cam weight 290 rests when it is fully engaged with one of the conical bores 270, 280. This embodiment may include two cam weights 290 to fill both conical bores 270, 280, one of which may be heavy and the other of which may be light. If only one cam weight 290 is provided, it preferably is composed of a high density material such as tungsten alloy, and preferably has a weight of 20-40 g, and more preferably approximately 32 grams.

In each of the embodiments disclosed herein, the conical bore 70, 170, 270, 280 alignment aid is disposed as close to the striking face 20, 110 as possible, and preferably is not spaced from the striking face 20, 110 by more than 0.500 inch.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

a body comprising a striking surface, a top surface, a bottom surface, a rear portion opposite the striking surface, a heel side, a hosel, and a toe side;

a cam weight;

a first conical bore extending into the body from the top surface; and a second conical bore extending into the body from the top surface, wherein the first conical bore is disposed closer to the striking surface than to the rear portion, wherein the second conical bore is disposed behind the first conical bore and is closer to the rear portion than to the striking surface, wherein the first conical bore comprises a plurality of alignment rings and a first pair of seating tabs protruding into the first conical bore and sized to engage the cam weight, wherein the second conical bore comprises a second pair of seating tabs protruding into the second conical bore and sized to engage the cam weight, wherein the first conical bore comprises an upper end having a first diameter and a lower end having a second diameter, wherein the first diameter is greater than the second diameter, wherein each of the first and second conical bores is centered between the heel side and the toe side, and wherein, when viewed from a location directly above the body, the alignment rings are fully visible and appear to be concentric.

2. The golf club head of claim 1, wherein the plurality of alignment rings comprises a first ring having a third diameter, a second ring having a fourth diameter, and a third ring having a fifth diameter, wherein the third diameter is greater than the fourth diameter, and wherein the fourth diameter is greater than the fifth diameter.

3. The golf club head of claim 2, wherein the first ring is disposed within the first conical bore proximate the top surface, wherein the third ring is disposed within the first conical bore proximate the bottom surface, and wherein the second ring is disposed within the first conical bore between the first and third rings.

4. The golf club head of claim 1, wherein the first conical bore comprises a surface comprising a first color, wherein at least one of the plurality of alignment rings comprises a second color that is different from the first color, and wherein the first color contrasts with the second color.

5. The golf club head of claim 4, wherein the first color is a light color and the second color is a dark color.

6. The golf club head of claim 5, wherein the first color is white and the second color is black.

7. The golf club head of claim 1, wherein at least one of the plurality of alignment rings protrudes into the first conical bore.

8. The golf club head of claim 7, wherein each of the plurality of alignment rings protrudes into the first conical bore.

9. The golf club head of claim 1, wherein the golf club head is a putter head.

10. The golf club head of claim 1, wherein the first diameter is approximately the same diameter as that of a golf ball.

11. The golf club head of claim 1, wherein the first diameter is less than 0.500 inch.

12. The golf club head of claim 1, wherein the bottom surface is composed of a transparent material.

13. A putter head comprising:

a body comprising a top surface, a bottom surface, a heel side, a toe side, a front surface comprising a recess, a hosel, and a rear portion;

a face insert sized to fit within the recess;

a conical bore extending into the top surface; and a cam weight, wherein the conical bore comprises a plurality of alignment rings and a plurality of seating tabs sized to engage the cam weight, wherein each of the plurality of seating tabs and at least one of the plurality of alignment rings protrudes into the conical bore, wherein the conical bore comprises an upper end having a first diameter and a lower end having a second diameter, wherein the first diameter is greater than the second diameter, wherein the conical bore is located closer to the front surface than to the rear portion, wherein the conical bore is centered between the heel and toe sides, and wherein when viewed from a location directly above the body, the alignment rings are fully visible and appear to be concentric.

14. The putter head of claim 13, wherein the first diameter is approximately the same diameter as that of a golf ball.

15. The putter head of claim 13, wherein the conical bore comprises a surface comprising a first color, and wherein at least one of the plurality of alignment rings comprises a second color that is different from the first color.

16. The putter head of claim 13, wherein the conical bore is spaced from the front surface by no more than 0.500 inch.

17. The putter head of claim 13, wherein the bottom surface is composed of a transparent material, and wherein the bottom surface is visible through the conical bore.

* * * * *